United States Patent [19]

Kuwata

[11] Patent Number: 4,944,149

[45] Date of Patent: Jul. 31, 1990

[54] COMBUSTOR LINER WITH AIR STAGING FOR NOX CONTROL

[75] Inventor: Masayoshi Kuwata, Ballston Lake, N.Y.

[73] Assignee: General Electric Company, Schenectady, N.Y.

[21] Appl. No.: 284,226

[22] Filed: Dec. 14, 1988

[51] Int. Cl.[5] ..... F23R 3/26

[52] U.S. Cl. ..... 60/39.23; 60/39.29

[58] Field of Search ..... 60/39.23, 39.29; 431/188, 187, 165

[56] References Cited

U.S. PATENT DOCUMENTS

| | | | |
|---|---|---|---|
| 3,691,761 | 9/1972 | Jackson et al. | 60/39.23 |
| 3,744,242 | 7/1973 | Stettler et al. | 60/39.23 |
| 3,765,171 | 10/1973 | Hagen et al. | 60/39.23 |
| 3,930,368 | 1/1976 | Anderson et al. | 60/39.23 |
| 3,930,369 | 1/1976 | Verdouw | 60/39.23 |
| 4,899,881 | 8/1975 | Arvin et al. | 60/39.23 |

*Primary Examiner*—Donald E. Stout
*Attorney, Agent, or Firm*—Nixon & Vanderhye

[57] ABSTRACT

The control of nitrogen oxides (NOx) is an important feature in the design and operation of gas turbines. It has been found that the production of NOx is affected by the fuel-air ratio within the combustor liner. To this end, an improved combustor liner is proposed which allows the distribution of combustion air and dilution air into the combustion liner in accordance with temperature conditions immediately surrounding the combustor liner. In one embodiment, an apertured ring is rotated in and out of register with dilution air holes in the liner to selectively affect the amount of dilution air and therefore also combustion air into the liner. The ring is driven by a temperature sensitve metals trip wound about the combustor liner. In another embodiment of the invention, the residence time of the combustion reaction is affected by the selection of upstream and or downstream dilution air holes in accordance with the position of the ring holes.

24 Claims, 2 Drawing Sheets

COMBUSTOR LINER WITH AIR STAGING FOR NOX CONTROL

This invention relates to gas turbines and, in particular, to combustion systems for gas turbines and to a device for minimizing the generation of nitrogen oxides, smoke and other undesirable pollutants from within the gas turbine combustor.

BACKGROUND OF THE INVENTION

The nature of gas turbines is such that they emit small amounts of undesirable pollutants into the surrounding atmosphere. Although smoke, excess carbon monoxide and unburned hydrocarbons all constitute undesirable pollutants in the exhaust of state-of-the-art gas turbines, it is the emission of excess amounts of nitrogen oxides (NOx) and carbon monoxides (CO) which causes particular concern, owing to the adverse affects attributed to these gases. Thus, it becomes particularly desireable to provide a gas turbine combustion system which operates with a minium amount of undesirable exhaust emission.

It is well known that lowering the temperature of combustion will decrease the concentration of nitrogen oxides in the turbine exhaust gases. It has also been demonstrated that buring the turbine fuel with excess air i.e., using a fuel-lean mixture in the combustion process, will accomplish such a temperature reduction. However, the leaness of the fuel-air mixture required to effect a flame temperature reduction at full turbine load may not support a satisfactory flame under low load or start-up conditions. When the latter conditions prevail, the turbine may operate at poor combustion efficiency, or not at all, if the fuel-air mixture used is the same fuel-air mixture used at full load. Incomplete burning of the fuel mixture will occur, resulting in the presence of excessive amounts of carbon monoxide and unburned hydrocarbons in the turbine exhaust.

In U.S. Pat. No. 4,297,842, assigned to the assignee of the present invention, it has been recognized that Nox control can be implemented by dividing the flow of compressor air to the combustor in two separate flows to the reaction zone and the dilution zone respectively and adding a NOx suppressant to the reaction zone airflow. However, it is noteworthy that the respective airflows between the reaction zone and the dilution zone is fixed by the combustor design.

In U.S. Pat. No. 4,255,927, assigned to the assignee of the present invention, provision is made for changing the flow volume of compressor air between the reaction zone and the dilution zone of a combustor. There are significant hardware requirements including ducting and a mechanical valve for distributing the flow of air between the two zones.

Another significant factor in the control of NOx is the time of the reaction referred to as "residence time". A shorter residence time will produce less NOx by limiting the exposure of free nitrogen and excess oxygen to combustion temperatures but a longer residence time may be needed to assure complete combustion to avoid the production of excessive hydrocarbons. It is desireable to be able to adjust residence time to an optimum for the pupose of minimizing the production of NOx without adversely affecting flame stability under changing loads and fuel flows.

It is therefore and object of the present invention to provide an improved combustor linear for minimizing the formation of NOx.

It is another object of the invention to provide a combustor liner effective for facilitating the control of NOx having a minimum of hardware changes from a conventional combustor liner.

It is another object of the invention to provide a combustor liner effective for controlling the formation of NOx for a gas turbine combustor which is passive (requiring no separate control) and reliable.

It is yet another object of the present invention to provide a combustor liner which will increase the turndown ratio of the gas turbine, i.e., the operational range of the gas turbine under which satisfactory performance is achieved.

These and other objects of the present invention, together with the features and advantages thereof will become more apparent from the following detailed description when read in combination with the accompanying drawings.

SUMMARY OF THE INVENTION

In accordance with the present invention, the formation of NOx within a gas turbine combustor is minimized under varying load conditions by controlling the distribution of reaction zone air and dilution zone air into the combustor liner. One embodiment of the invention includes a ring having ring holes formed therein mounted around the combustor liner for selectively covering and uncovering dilution air holes in the liner depending upon the current operational mode of the gas turbine. The ring is positioned by a temperature sensitive metal strip which is wound about the combustor liner and which expands under increasing load and temperature in the gas turbine. Since the metal strip is wound about the combustor liner, elongation of the metal strip due to temperature increase will cause the ring to rotate. In another embodiment of the invention, the ring includes upstream and downstream ring holes which are in selective register with respective upstream and downstream dilution air holes in the combustor liner and which under conditions of increased load will cause the upstream dilution air holes to become uncovered so as to admit air into the combustor at an upstream location in the reaction zone thereby lessening the residence time in the reaction zone by, in effect, extending the dilution zone upstream into the reaction zone.

BRIEF DESCRIPTION OF THE DRAWINGS

In FIG. 2(*a*) holes are fully aligned; in FIG. 2(*b*) holes are partially aligned;

In FIG. 4(*a*) the downstream ring holes are open, and in FIG. 4(*b*) the upstream ring holes are open.

DETAILED DESCRIPTION OF THE INVENTION

Figure 1:
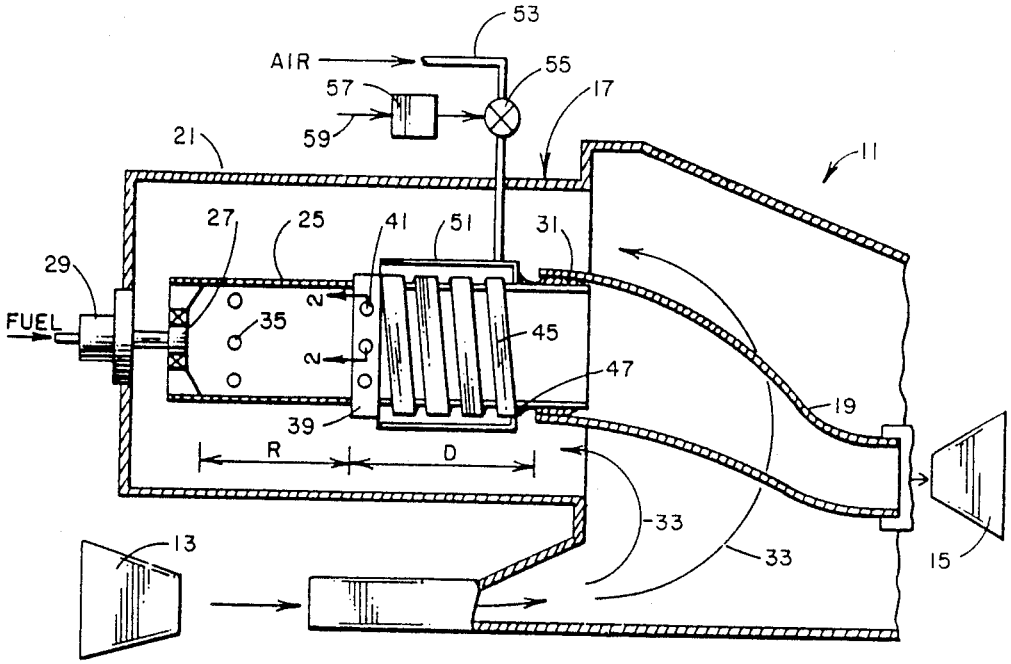
FIG. 1 is a cross-section schematic view of a gas turbine with emphasis upon the combustor part of the gas turbine and showing one embodiment of the present invention.

FIG. 1 is a cross-sectional schematic of a gas turbine 11 including a compressor 13, a turbine 15 and a combustor 17. The compressor provides a compressed air supply to the combustor 17 which mixes fuel and air in the presence of an igniter to produce a hot exhaust gas which is used to drive the turbine thereby producing a mechanical output. The turbine may, in turn, be connected to drive the compressor in the usual manner. There may be six or eight combustors 17 (only one shown) which are arranged in an annulus with respect to the gas turbine to deliver hot exhaust gas to the turbine, each through its own transition duct 19. Each combustor includes a combustor outer casing 21 which contains its share of the compressor discharge air.

The combustor further includes a combustor liner 25 in which the combustion process actually takes place. A fuel delivery nozzle 27 is inserted in the upstream end of the combustion liner and is supplied with fuel through a fuel inlet connector 29 in the outer combustion casing. The combustion liner is connected at its downstream end with the inlet end of the transition duct 19 at a flanged connection 31.

The combustor shown is a reverse flow combustor wherein the compressor discharge air (arrows 33) enters the combustor casing 21 around the downstream end of the combustor liner and flows toward the upstream or fuel nozzle end of the combustor liner where it enters the combustor liner through the fuel nozzle where it is mixed with fuel. Although it is not shown in detail in FIG. 1, it is well known that some fuel nozzles are equipped with angled blades called swirlers which help promote the mixing of fuel and air as the fuel leaves the nozzle. The combustor liner may be divided into two zones for purposes of further delivery of air into the liner. This excludes the normal liner cooling air which is inducted into the combustor liner through louvered openings. The combustor liner may be divided into a reaction zone R which is upstream and immediately adjacent the nozzle discharge and a dilution zone D which is downstream from the reaction zone and extends toward the transition duct. Another aspect of this invention which will be discussed later to show that the length of the reaction zone may be effectively changed so as to alter the "residence time" of the combustion reaction in the reaction zone.

A plurality of combustion air holes 35 are formed in the combustor liner for the purpose of supplying combustion air to the reaction zone R of the combustor liner. Although not shown in FIG. 1 but shown in FIG. 2, the combustion liner 25 also includes a plurality of dilution air holes 37 for supplying air to the dilution zone D of the combustor liner. The foregoing description thus far is well known in the art.

Figure 2A:
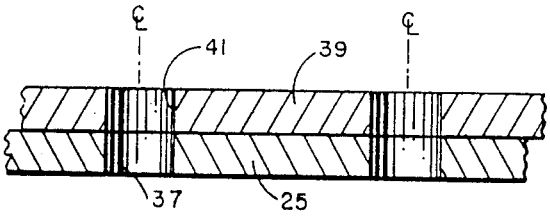
FIG. 2 is a cross-section taken at 2—2 of FIG. 1.
Figure 2B:
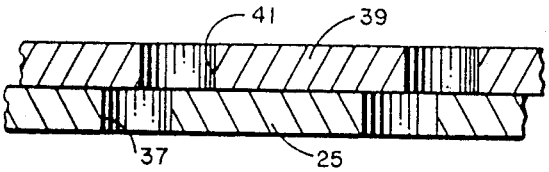

In accordance with the present invention, there are means for covering and uncovering the dilution air holes in the form of a ring 39 which is disposed about the combustor liner and is movable with respect to the liner. Such movement may take the form of axial movement of rotation of the ring. The ring also is formed with ring holes which go in and out of register with the dilution air holes in a manner shown in FIG. 2. Since the ring 39 may move relative to the combustor liner 25, it is also true that the ring holes 41 will move relative to the dilution air holes. If the ring holes are aligned with the dilution air holes so that their centerlines coincide, then full flow through the respective aligned holes will take place. If the centerlines are displaced from one another, FIG. 2(*b*), then less than full flow will occur as shown in FIG. 2(*b*).

Further, as part of the invention, there are means for moving the ring 39. A preferred form of such means includes a metal strip 45 which is wound about the exterior of the combustor liner. The metal strip is fixed at the downstream end to any convenient part 47 of the combustor liner so that it is free to elongate in the upstream direction where it is attached at its free end to the ring 39. Elongation of the metal strip due to a temperature increase will cause the ring to rotate because of the metal strip being wrapped about the combustor liner.

A thermally insulating housing 51 is positioned about the metal strip 45 and that portion of the combustor liner around which the meal strip is wound. The function of the thermal housing is to isolate the metal strip from the flow of compressor air Therefore, the thermal performance of the metal strip is directly dependent upon the combustor liner temperature which is, in turn, linearly dependent upon the performance of the gas turbine. In addition to the housing 51, a further embodiment may include a source of air which is input directly into the housing 51 through pipe 53. The flow of air is controlled by a valve 55 which is set by a controller 57. An input control signal 59 regulates the flow of air so as to control the environment about the metal strip so that the gas turbine operator can control the positioning of the ring if so desired or required. The control parameters useful for such a controller as well as the controller itself are well known in the art.

The operation of the invention thus far described is as follows. It is well known that lowering the temperature of combustion will decrease the concentration of NOx in turbine exhaust gases. It has also been demonstrated that burning the turbine fuel with excess air, i.e., using a fuel-lean mixture in the combustion process will accomplish such a temperature reduction. However, the leaness of the fuel-air mixture required to effect a flame temperature reduction at full turbine load will not support a satisfactory flame under low load or start-up conditions. Therefore, as an example and in accordance with the foregoing principles, it can be seen that the present invention would operate so that under a full load condition there might be a 50/50 split of air flow between the dilution air holes and the combustion air holes to obtain satisfactory NOx, flame and hydrocarbon performance; but should there be a decrease in load and hence fuel flow, then it would be desired to decrease the flow of air to the reaction zone through the combustor liner holes by increasing the flow of air into the dilution holes so that there might be a 25/75 split of air between the combustion air holes and the dilution air holes under, for example, half-load conditions. This would be accomplished in accordance with the present invention by sizing the metal strip and the location of ring holes so that as the temperature of combustor rises under a load increase, the dilution air holes would gradually close as indicated in FIG. 2(*b*) resulting in more air being transferred to the reaction zone whereas under load decreasing, the metal strip would expand to bring the ring holes and dilution air holes more into alignment with one another as shown in FIG. 2(*a*) thereby channeling more air into the dilution zone and less air into the reaction zone.

Figure 3:
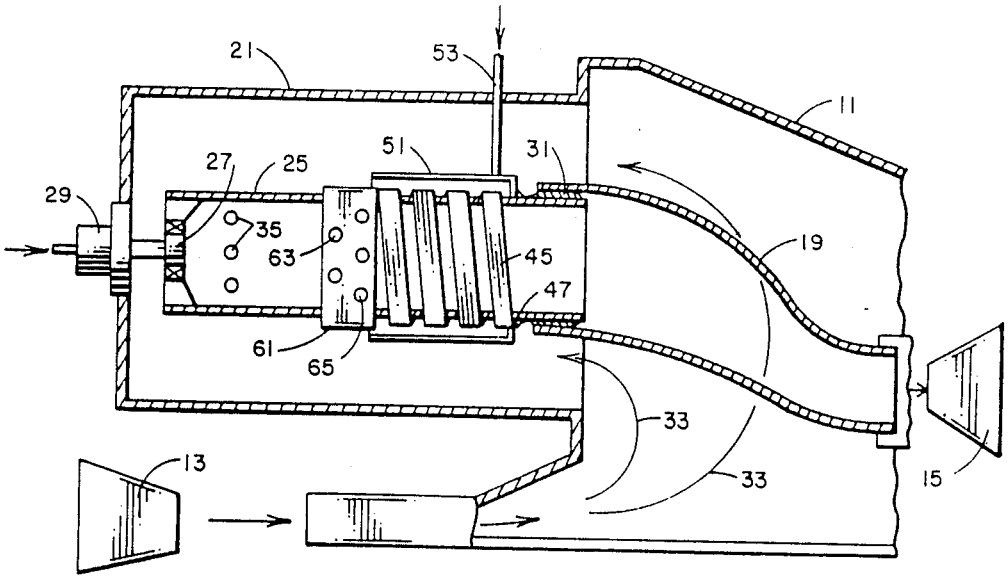
FIG. 3 is a cross-section schematic view of a gas turbine with emphasis upon the combustor part of the gas turbine and showing another embodiment of the present invention.
Figure 4A:
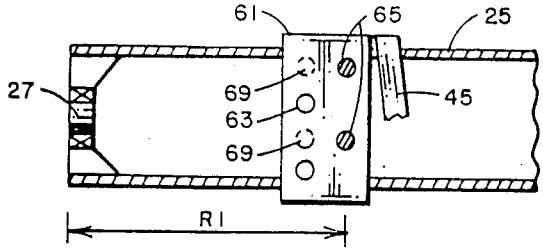
FIG. 4 is a schematic view of the combustor liner shown in FIG. 3 showing the operation of the ring portion of the combustor liner.
Figure 4B:
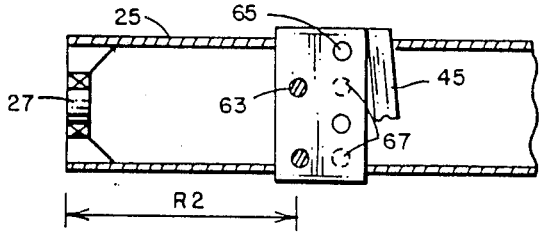

A further aspect of the present invention may be appreciated with reference to FIGS. 3 and 4 wherein the same numerals are used for like parts that are shown in FIGS. 1 and 2. In accordance with the invention, the production of NOx is also affected by residence time, i.e., the time that the combustion reaction is allowed to occur which is proportional to the axial length of the combustor reaction zone. Again, under certain loading conditions such as startup or low load conditions, a longer residence period may be required to assure flame stability and complete combustion. On the other hand, under full load conditions it may be beneficial toward minimizing the production of NOx to reduce the residence time. To this end, a modified ring 61 as shown in FIG. 3 is disposed about the combustor liner. The ring includes upstream ring holes 63 and downdstream ring holes 65. All references to upstream and downstream in this application are with respect to the direction of flow of the combustion gases which is from the nozzle 27 to the transition duct 19.

With reference to FIG. 4, rotation of the ring 61 so that downstream ring holes 65 are aligned with downstream dilution air holes 67 (indicated as hidden in FIG. 4(*b*) will cause a reaction zone having a longer axial length R1. This is because dilution air is first admitted into the combustor liner interior through downstream dilution air holes and ring holes 65 shown as shaded. This means the residence time of the combustion reaction will be increased usually under conditions of low load. The driver of the ring 61 will be metal strip which will rotate ring 61 so that downstream dilution air holes 67 are in register with downstream ring holes 65. On the other hand, upstream dilution air holes 69 remain covered by the ring 61 and hence no air is admitted into the combustor liner at this point.

When full load is established so that residence time may be decreased, the ring 61 will be caused to rotate by the increased temperature expanding the metal strip so that the upstream ring holes 63 coincide with the upstream dilution air holes 69 allowing an earlier introduction of dilution air into the combustor liner thereby decreasing the residence time of the combustion reaction.

A combustion liner has been described which will minimize the production of NOx through a self-regulating device which acts to cover and uncover dilution air holes in the combustor liner. Such device is directly responsive to gas turbine thermal conditions surrounding the combustor liner. In one form of the invention, the device includes a ring which is mounted around the combustor liner and which includes a plurality of ring holes. The ring is movable with respect to the liner for covering and uncovering the dilution air holes by bringing the ring and dilution air holes into and out of register with one another. This may be accomplished by rotating the ring. Further, the ring may be rotated by a thermally sensitive metal strip which is wound about the combustor circumference so that when the strip expands or elongates, the ring is rotated. A temperature insulating housing is positioned around the metal strip so that localized heating of the strip of effected without interference by the passing compressor air which surrounds the combustor liner. On the other hand, the housing may be supplied with a controlled air supply to maintain a temperature range within the housing which is regulated to produce a desired range of thermal expansion of the metal strip. In another embodiment of the invention, a metal ring with upstream and downstream holes is used to change the residence time of the combustion reaction by selectively allowing the introduction of dilution air into the combustor liner at either upstream or downstream dilution air locations.

While there has been shown what is considered to be the preferred embodiments of the invention, other modifications may occur to those having skill in the art. One such modification may include covering and uncovering the combustion air holes in a manner similar to that which is described for the dilution air holes using a similar metal strip device as is described herein. It is intended to claim all such modifications as would fall within the true spirit and scope of the appended claims.

What is claimed is:

1. A cylindrical combustor liner including an upstream portion comprising a reaction zone and downstream portion comprising a dilution zone; a first plurality of dilution air holes disposed through the liner for admitting air into the dilution zone and a first plurality of combustion air holes for admittng air into the reaction zone; and, means for covering and uncovering one of the pluraltity of dilution air holes or the combustion air holes for regulating the flow of air through the dilution air holes and the combustion air holes into the combustor liner, said means being operative to increase air flow through the dilution air holes and to decrease air flow to the reaction zone upon a decrease in load and fuel flow to an associated combustor.

2. The combustor liner recited in claim 1 where said means covers and uncovers one or more of the plurality of dilution air holes.

3. The combustor liner recited in claim 1 wherein the means for covering and uncovering the dilution air holes is directly responsive to the temperature of the combustor liner.

4. The combustor liner recited in claim 2 wherein said means for covering and uncovering one or more of the plurality of dilution air holes is isolated from air flow in said liner.

5. The combustor liner recited in claim 2 wherein the means for covering and uncovering the dilution holes includes a ring mounted around the circumference of the combustor liner.

6. The combustor liner recited in claim 5 wherein the ring is rotatable with respect to the combustor liner.

7. A cylindrical combustor liner including an upstream portion comprising a reaction zone and a downstream portion comprising a dilution zone; a first plurality of dilution air holes disposed through the liner for admitting air into the dilution zone; and, means for covering and uncovering the dilution air holes for regulating the flow of air through the dilution air holes into the dilution zone wherein the liner includes axially spaced upstream and downstream dilution air holes and the covering and uncovering means includes axially spaced upstream and downstream holes for covering and uncovering said upstream and downstream dilution air holes of said liner, respectively, whereby as the upstream dilution air holes are uncovered, the reaction zone is effectively decreased in axial length, and combustion residence time is shortened.

8. The combustor liner recited in claim 7 wherein the means for covering and uncovering the dilution air holes is directly responsive to the temperature of the combustor liner.

9. The combustor liner recited in claim 7 wherein the means for covering and uncovering the dilution air holes includes a ring mounted around the circumference of the combustor liner; the ring including said plurality of axially spaced upstream and downstream holes which are in selectable register with said plurality of axially spaced upstream and downstream dilution air holes in said liner; and, the ring being movable with repect to the combustor liner for covering and uncovering said dilution air holes.

10. The combustor liner recited in claim 9 wherein the ring is rotatable with respect to the combustor liner.

11. The combustor liner recited in claim 9 and further including means directly responsive to the temperature of the combustor liner for moving the ring to cover and uncover said plurality of axially spaced upstream and downstream dilution air holes.

12. The combustor liner recited in claim 11 wherein the ring is rotatable with respect to the combustor liner.

13. The combustor liner recited in claim 11 wherein the means for moving the ring includes a metal strip which is wound about the combustor liner and fixed at one end to the downstream end of the combustor liner and attached at the other end to the ring whereby an increase in combustor liner temperature will cause elongation of the metal strip which will, in turn, cause rotation of the metal ring.

14. The combustor liner recited in claim 13 wherein the expansion of the metal strip causes the ring to rotate so as to move the ring holes out of register with the dilution air holes thereby causing less air to flow into the combustor liner through the dilution air holes.

15. The combustor liner recited in claim 13 further comprising a temperature insulating housing positioned about the metal strip whereby the metal strip is directly responsive to the temperature of the combustor liner.

16. The combustor liner recited in claim 15 further including a source of cooling air connected to the housing for further controlling the movement of the metal strip.

17. An improved cylindrical combustion liner including an upstream portion comprising a reaction zone and a downstream portion comprising a dilution zone; a first plurality of dilution air holes disposed through the liner for admitting air into the dilution zone wherein the improvement comprises:

means for covering and uncovering the dilution air holes including a ring mounted around the circumference of the combustor liner, the ring having a plurality of ring holes which are in selectable register with the dilution air holes; and a metal strip coiled about the circumference of the combustor liner and fixed at one end to the combustor liner and attached at the other end to the movable ring whereby as the metal strip is heated, the ring is rotated to move the ring holes into and out of register with the dilution air holes.

18. The improved cylindrical combustion liner recited in claim 17 wherein the improvement further comprises:

a housing positioned about the metal strip for insulating the metal strip from surrounding air.

19. The improved combustor liner recited in claim 18 wherein the improvement further comprises a pipe connecting the housing to a source of air for regulating the temperature within the housing.

20. The improved combustor liner recited in claim 17 wherein the plurality of dilution air holes includes upstream and downstream dilution air holes in the combustor liner and the plurality of ring holes are arranged to selectively cover and uncover the plurality of dilution air holes.

21. A combustor liner including an upstream portion comprising a reaction zone and a downstream portion comprising a dilution zone; a first plurality of dilution air holes disposed through the liner for admitting air into the dilution zone; and, means for covering and uncovering the dilution air holes for regulating the flow of air through the dilution air holes into the dilution zone;

wherein said means for covering and uncovering the dilution holes includes:

a ring mounted around the circumference of the combustor liner;

a plurality of ring holes formed within the ring and spaced apart to be in selectable register with the dilution air holes in the combustor liner; and means directly responsive to the temperature of the combustor liner for moving the ring to cover and uncover the dilution holes;

wherein the means for moving the ring includes a metal strip which is wound about the combustor liner and fixed at one end to the downstream end of the combustor liner and attached at the other end to the ring whereby an increase in combustor liner temperature will cause elongation of the metal strip which will, in turn, cause rotation of the metal ring.

22. The combustor liner recited in claim 21 wherin the expansion of the metal strip causes the ring to rotate so as to move the ring holes out of register with the dilution air holes thereby causing less air to flow into the combustor liner through the dilution air holes.

23. The combustor liner recited in claim 21 further comprising a temperature insulating housing positioned about the metal strip whereby the metal strip is directly responsive to the temperature of the combustor liner.

24. The combustor liner recited in claim 23 further including a source of cooling air connected to the housing for further controlling the movement of the metal strip.

* * * * *